US007256726B2

(12) United States Patent
Bejean

(10) Patent No.: US 7,256,726 B2
(45) Date of Patent: Aug. 14, 2007

(54) METHOD OF DISABLING THE KEYBOARD KEYS OF A COMMAND-EMITTING DEVICE

(75) Inventor: Alain Bejean, Grussy (FR)

(73) Assignee: Somfy SAS, Cluses (FR)

( * ) Notice: Subject to any disclaimer, the term of this patent is extended or adjusted under 35 U.S.C. 154(b) by 208 days.

(21) Appl. No.: 10/525,694

(22) PCT Filed: Aug. 27, 2003

(86) PCT No.: PCT/IB03/03786

§ 371 (c)(1),
(2), (4) Date: Feb. 22, 2005

(87) PCT Pub. No.: WO2004/023502

PCT Pub. Date: Mar. 18, 2004

(65) Prior Publication Data

US 2005/0237230 A1 Oct. 27, 2005

(30) Foreign Application Priority Data

Sep. 5, 2002 (FR) ..... 02 10999

(51) Int. Cl.
*G08C 19/12* (2006.01)

(52) U.S. Cl. ..... 341/176; 341/20; 701/36; 340/568.1; 340/3.1

(58) Field of Classification Search ..... 341/20, 341/22, 173, 176; 701/36; 455/565; 340/825.36, 340/506, 539.11, 568.1, 3.1
See application file for complete search history.

(56) References Cited

U.S. PATENT DOCUMENTS

| | | | | |
|---|---|---|---|---|
| 3,906,814 A | | 9/1975 | Magnussen | 74/483 |
| 4,544,924 A | | 10/1985 | French | 340/825.69 |
| 4,820,887 A | | 4/1989 | Schmitz | 200/43.18 |
| 4,992,784 A | | 2/1991 | Ruttiger | 340/825.72 |
| 5,290,979 A | | 3/1994 | Grass | 200/43.19 |
| 5,385,417 A | | 1/1995 | Wade et al. | 400/472 |
| 5,864,765 A | * | 1/1999 | Barvesten | 455/565 |
| 6,005,497 A | | 12/1999 | Snyder | 341/22 |
| 6,246,862 B1 | | 6/2001 | Grivas et al. | 455/90 |
| 6,330,457 B1 | | 12/2001 | Yoon | 455/550 |
| 6,718,240 B1 | * | 4/2004 | Suda et al. | 701/36 |

FOREIGN PATENT DOCUMENTS

| | | |
|---|---|---|
| DE | 4326272 | 2/1995 |
| EP | 0 453 089 A2 | 10/1991 |
| EP | 0 930 409 A1 | 1/1999 |
| EP | 0924915 A1 | 6/1999 |
| EP | 0930409 A1 | 10/2002 |
| WO | WO 2004/023502 A1 | 3/2004 |

* cited by examiner

*Primary Examiner*—Albert K. Wong
(74) *Attorney, Agent, or Firm*—Frommer Lawrence & Haug LLP; Ronald R. Santucci

(57) ABSTRACT

The invention relates to a method of disabling the keyboard keys of a command-emitting device. The inventive method is characterised in that it comprises repeated iterations of the following steps: the automatic disabling of at least some keys on the command-emitting device once a command has been sent and the cancellation of said key-disabling operation by means of a specific action on the command-emitting device. One such method can be used to disable the keyboard keys of a command-emitting device when said device is being placed in a pocket or bag.

11 Claims, 1 Drawing Sheet

METHOD OF DISABLING THE KEYBOARD KEYS OF A COMMAND-EMITTING DEVICE

RELATED APPLICATIONS

This is the national phase application of PCT application no. WO 04/023502A1 filed Aug. 27, 2003, claiming priority from French application no. 0210999 filed Sep. 5, 2002.

BACKGROUND OF THE INVENTION

The invention relates to a method of disabling the buttons of the keypad of a command transmitter intended to control an appliance. The invention further relates to a command transmitter comprising a microcontroller connected to buttons and to means for transmitting commands and intended to implement such a method.

Such a method applies in particular to the remote control, for example by radio frequencies, of maneuvering or locking of doors, such as garage doors or entrance doors to dwellings.

More generally, the invention may be applied to the fields of security of access and/or of protection by alarm. When the command transmitter is portable and, in particular, when it is transported in the pocket or in the bag of a user, there is a risk of accidental pressing of the control buttons of the transmitter.

DESCRIPTION OF THE PRIOR ART

This problem of accidental pressing is known. Various solutions have been devised to remedy same.

U.S. Pat. Nos. 3,906,814 and 5,290,979 disclose control devices exhibiting members making it possible to mechanically lock certain buttons so as to prohibit their use.

U.S. Pat. No. 4,820,887 discloses a keypad with membrane exhibiting more or less rigid covers overlying the critical buttons of the keypad and making it possible to render an action on them impossible or more difficult.

U.S. Pat. No. 5,385,417 furthermore discloses a rigid cover intended to overlay a button and exhibiting a hole such that this button can be actuated by a pointed object such as the tip of a pen.

Moreover, it is common for the power supply to a portable device, such as a telephone or small calculator, to be turned on by opening a hood for protecting the keypad, the power supply having the consequence of rendering the buttons of the keypad active. Such devices are described in Patent EP 0 924 915 and in U.S. Pat. No. 6,005,497. Within the same field, Application EP 0 453 089 discloses a portable telephone whose buttons may be disabled following an action by the user on certain of them, it being possible, through the same action, for the buttons to be re-enabled.

Also, U.S. Pat. No. 4,544,924 discloses a remote control device, for example for a television or video recorder, whose power supply is activated by pressing any button of the keypad and deactivated automatically after the transmission of the command associated with the button so as to save energy.

Application EP 0 930 409 describes a system for remote control of functions in a vehicle. The application establishes a distinction between centralized closing functions and comfort functions. Certain functions have to be activated as long as a receiver receives a command from a transmitter. To avoid the interruption of these functions through a problem with sending following a slight movement of the transmitter when the latter is at the range limit, the receiver's sensitivity threshold is lowered for a certain time from the start of the command transmission.

Finally, U.S. Pat. No. 4,992,784 discloses a remote control device requiring, in order to transmit certain particular commands, simultaneous pressing of several buttons. The procedure renders the transmission in error of these particular commands improbable. In the same way, on PC computers, the operating systems of the Microsoft Company require simultaneous pressing of the "Ctrl", "Alt" and "Del" buttons so as to perform a hot restart (reset).

However, the solutions of the prior art have a problem. They are not applicable to portable command transmitters and, in particular, of "key-holder" type or do not meet the requirement exactly. This type of transmitter controlling the opening of doors affording access to the whole of a building or making it possible to activate or deactivate an alarm, it is necessary to guarantee that inadvertent pressing of one of the buttons of the command transmitter will not bring about the opening of a door or the deactivating of the alarm.

The aim of the invention is to provide a disabling method improving the solutions of the prior art and alleviating the abovementioned problem. In particular, the invention proposes to provide a method allowing the disabling of the buttons of the keypad of a command transmitter when the latter is slipped into a pocket or into a bag and to embody a command transmitter allowing the implementation of such a method.

SUMMARY OF THE INVENTION

The method according to the invention is characterized by the characterizing part of claim 1.

The dependent claims 2 to 7 define various modes of execution of the method according to the invention.

The command transmitter according to the invention is defined by claim 8.

Dependent claim 9 defines a variant embodiment of the command transmitter.

DESCRIPTION OF THE DRAWINGS

The appended drawing represents, by way of example, a mode of execution of the method according to the invention.

DESCRIPTION OF THE PREFERRED EMBODIMENTS

Figure 1:
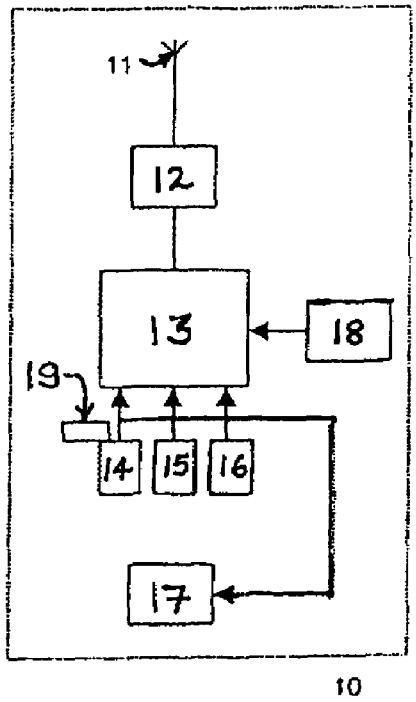
FIG. 1 is a diagram of a command transmitter allowing the execution of the method according to the invention.

FIG. 1 represents in diagrammatic form a command transmitter 10 allowing the execution of the method according to the invention. This command transmitter 10 comprises a microcontroller 13 connected to a keypad with several buttons 14, 15, 16 and to a radiofrequency transmitter 12, itself connected to an antenna 11. This command transmitter is powered by a battery 17.

For illustration, it is assumed that this command transmitter makes it possible to control the opening and the closing of a garage door and the activation and the deactivation of an alarm. The button 14 controls both the opening of the door and the deactivating of the alarm. The button 16 controls both the closing of the door and the activating of the alarm and the button 15 is a button for stopping the maneuvering of the door.

This command transmitter communicates with one or more command receivers (not represented) operating the garage door and the alarm.

Figure 2:
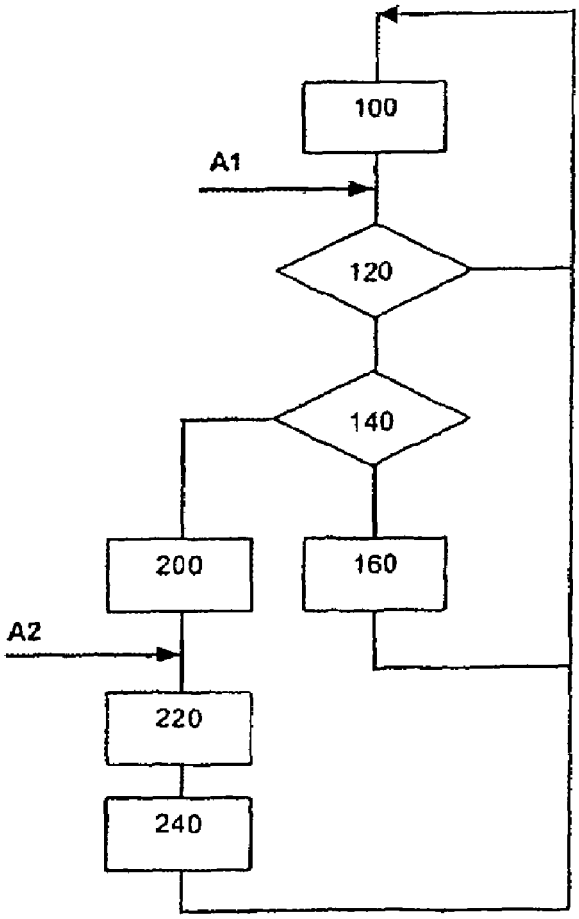
FIG. 2 is a flow chart of the method according to the invention.

In the flow chart of FIG. 2 it is assumed firstly that the command transmitter is partially disabled. In this state, pressing the buttons of the keypad (except certain so-called specific buttons) has no consequence. A program 100 permits the reading of the buttons of the keypad and places a disabling indicator into an active state.

An intentional or unintentional action by the user on one or more buttons of the keypad is represented by an arrow A1.

This pressing brings about the activation of a test program 120 making it possible to determine whether the button or one of the buttons actuated is a specific button, that is to say whether one of the buttons is not disabled. If all the buttons actuated are disabled, then there is a loopback to the program 100. If, on the contrary, one of the buttons actuated is a specific button, then a test program 140 is activated. This test makes it possible to determine whether the pressing of the button or the buttons corresponds to a specific sequence of presses such as a determined series of presses but which may also be regarded as a long press.

If a specific sequence is not involved, a program 160 is activated. The latter brings about the transmission by the command transmitter of the command corresponding to the specific button actuated. For example, the command transmitter can exhibit the stop button 15 as sole specific button. For safety reasons, even brief pressing of this button stops the maneuvering of the door.

If a specific sequence is involved, a program 200 is activated. The latter brings about the cancellation of the disabling, that is to say all the buttons of the keypad become active.

A new action on a button of the keypad is represented by the arrow A2. This action brings about the activation of a program 220 that then allows the command transmission corresponding to the button actuated.

After this transmission, a program 240 is activated. This program brings about the disabling of the buttons of the keypad with the exception of the specific buttons. This program is executed either just after the transmission of the order, or after a timeout that may possibly allow the transmission of other commands to the command receiver. In the latter case, any new action on one of the buttons of the keypad correspondingly prolongs the time window during which the buttons remain active.

In an other execution of the method, there are two specific buttons. The first is the stop button 15 as before and the second is the open button 14. If this button is protected by mechanical means 19, its activation may give rise to the cancellation of the disabling of the buttons. Thus, the test programs 120 and 140 pertain to the identification of the button actuated:

- if a button other than the two specific buttons is involved, there is a loopback to the program 100,
- if the stop button 15 is involved, there is a command transmission associated with the button and loopback to the program 100,
- if the protected button 14 is involved, there is a command transmission associated with the button and a temporary cancellation of disabling.

Likewise, the two variants may be combined, in the case where no button is protected mechanically: on the one hand, the specific stop button remains non-disabled and, on the other hand, prolonged pressing or a particular sequence pertaining to other buttons makes it possible to render the buttons active. A program replacing the programs 120 and 140 then tests whether the stop button is actuated or whether a particular sequence of presses is involved. In the first case, there is transmission of the command corresponding to the button actuated, in the second case, there is temporary cancellation of disabling. If the press does not correspond to either of the two above cases, there is then looping to the program 100.

Finally, it is clear that a tight coupling may be achieved between, on the one hand, the hardware components and, on the other hand, the software components of the command transmitter so as to obtain such behavior. Provision may thus be made for only certain buttons of the keypad to be able to activate the power supply 17 to the transmitter or to be able, in an analogous manner, to exit the microcontroller and/or the transmitter from a sleep mode.

When envisaging such a case, the action A1 may be applied only to certain buttons (if not it is ignored by the microcontroller). The test program 120 becomes unnecessary and the test program 140 is geared towards the simple execution of the command if the stop button is involved or towards the temporary cancellation of disabling if a particular press sequence is recognized.

The program 100 then consists in bringing about the switch to sleep mode or the partial disconnection of the power supply.

The command transmitter may optionally exhibit a sensor of grasping in the hand 18.

The cancellation of the disabling of the buttons may in this case be brought about by a signal from the sensor of grasping in the hand 18.

This sensor may be of thermal, galvanic or capacitive type, or may even consist of a pressure detector. U.S. Pat. Nos. 6,330,457 and 6,246,862 disclose sensors used for a use that is strictly opposite to that addressed by the invention since it involves barring the use of the buttons of a telephone when the latter switches to operational mode.

If the sensor delivers a signal indicating that the command transmitter is held in the hand and not rattling around in a pocket or in a bag, then this signal may be used to control the cancellation of the disabling of the buttons. Likewise, the disappearance of the signal may be used to bring about the disabling of the buttons.

The invention claimed is:

1. A method of disabling the buttons of the keypad of a command transmitter intended to control an appliance for security and/or access control in a building, which comprises repetitions of the following steps:

- automatic disabling of at least certain buttons of the command transmitter after a command is sent, while specific buttons remain active to send at least a safety command; and
- cancellation of the disabling of the buttons through a specific action on the command transmitter.

2. The method as claimed in claim 1, wherein the disabling is done immediately after a command is sent by the command transmitter.

3. The method as claimed in claim 1, wherein the disabling is done on completion of a timeout triggered after a command is sent by the command transmitter.

4. The method as claimed in claim 1, wherein the disabling is brought about when a signal from a sensor for detecting grasping of the command transmitter in the hand is not transmitted.

5. The method as claimed in claim 1, wherein the cancellation of the disabling is brought about by a specific manipulation of one or more specific buttons.

6. The method as claimed in claim 1, wherein the cancellation of the disabling is brought about by an action on a mechanical locking means.

7. The method as claimed in claim 1, wherein the cancellation of the disabling is brought about by a signal transmitted by a sensor for detecting grasping of the command transmitter in the hand.

8. A command transmitter comprising:

a microcontroller connected to buttons and to means for transmitting commands to control an appliance for security and/or access control in a building, the microcontroller comprising a program allowing the implementation of the method according to claim 1.

9. The command transmitter as claimed in claim 8, further comprising a sensor for detecting grasping of the command transmitter in the hand.

10. A command transmitter comprising:

a microcontroller connected to buttons for transmitting radiofrequency commands to control an appliance for security and/or access control in a building, wherein specific buttons remain active in a partially inhibited mode, at least some of them remaining active to send safety commands, the non-specific buttons having no effect in this partially inhibited mode.

11. The command transmitter of claim 10, in which the partially inhibited mode can be cancelled by a specific sequence on the specific buttons.

* * * * *